United States Patent [19]

Effenberger et al.

[11] 4,036,006

[45] July 19, 1977

[54] TIME-KEEPING APPARATUS

[75] Inventors: Hubert Effenberger, Neckargroningen; Walter Seeger, Pforzheim, both of Germany

[73] Assignees: Gunther Glaser, Stuttgart; Hubert Effenberger, Neckargroningen, both of Germany

[21] Appl. No.: 621,083

[22] Filed: Oct. 9, 1975

Related U.S. Application Data

[63] Continuation of Ser. No. 439,904, Feb. 6, 1974, abandoned.

[51] Int. Cl.[2] ..... G04C 3/00

[52] U.S. Cl. ..... 58/23 R; 58/23 A; 58/28 R; 331/116 M

[58] Field of Search ..... 58/23 A, 23 V, 24 R, 58/28 R; 318/128; 331/116 M

[56] References Cited

U.S. PATENT DOCUMENTS

| | | | |
|---|---|---|---|
| 3,597,634 | 8/1971 | Flaig | 58/28 R X |
| 3,711,754 | 1/1973 | Nemoto | 58/23 X |
| 3,807,164 | 4/1974 | Zaisky et al. | 58/28 R |

*Primary Examiner*—Ulysses Weldon
*Attorney, Agent, or Firm*—Edwin E. Greigg

[57] ABSTRACT

A time-keeping apparatus uses a crystal oscillator and electronic frequency dividers, as well as an electronically regulated mechanical time-keeping system (balance wheel system) which is part of an indicating system. The indicating system is driven at at least two different rpm's; at least one of these rpm's is effectively controlled to be higher and at least one of these rpm's can be controlled to be lower than a nominal rpm corresponding to the frequency of oscillation of the crystal oscillator, which may be of quartz. A storage circuit, in the form of a bistable multivibrator, has one input coupled to an output of a frequency divider which, in turn, is controlled by the output from the crystal oscillator. The other input to the storage circuit is provided with input pulses derived from the indicating system or from the electronically controlled mechanical time-keeping system, which have very nearly the same frequency as the pulses of the output of the frequency divider fed from the crystal oscillator. The output from the bistable multivibrator is coupled, via a switching circuit, to the electronically controlled balance wheel system.

11 Claims, 4 Drawing Figures

TIME-KEEPING APPARATUS

This is a continuation of application Ser. No. 439,904, filed Feb. 6, 1974, now abandoned.

BACKGROUND OF THE INVENTION

This invention relates to a time-keeping apparatus which includes an electronically regulated indicating system. The invention relates to a time-keeping apparatus, in particular a wrist watch which contains a quartz oscillator and electronic frequency dividers, as well as an electronically regulated mechanical time-keeping system which is part of an indicating system.

Quartz wrist watches are known which contain a quartz oscillator in combination with a frequency divider and an electro-mechanical indicating system controlled directly by the output pulses of the frequency divider.

Particular disadvantages of known quartz time-keeping systems, especially wrist watches, consist in that the mechanical indicating system of such watches requires a relatively high power input in order to achieve a high stepping reliability; this power input can be reduced only if a greater sensitivity is permitted. The high sensitivity results in the system or watch becoming undesirably responsive to disturbances. Furthermore, in known systems which employ directly controlled stepping motors or directly synchronized oscillating systems and conventional motors, a design is necessary which must correct or reverse possible errors within a single stepping period. In such systems, the sensitivity to shocks, for example, during a wearer's exercise in sports, can result in a permanent deviation of the setting.

In order to avoid these disadvantages substantially, it has heretofore been necessary to provide expensive special devices for the indication and stepping system; for example, oscillating systems having high energy content, i.e. having large amplitudes and high frequencies.

As experiments and practical results of utility quartz watches, especially of wrist watches, have shown, these difficulties occur in principle in all previously employed versions of electro-mechanical drive means for indication systems, whether they are tuning fork, leaf spring or balance wheel systems, synchronous motors, synchronized motors, directly synchronized oscillating systems, stepping motors or electro-mechanical stepping mechanisms. Attempts have been made, therefore, to install blocking devices in stepping systems in order to prevent an undesired stepping due to disturbances, for example, mechanical shocks and the like. However, these blocking devices are also subject to disturbances if an external mechanical disturbing pulse occurs during the stepping process.

In watches employing balance wheel oscillating systems having a frequency of 2.5 Hz, shaking motions and rotational shocks as can occur during rapid hand motions in sports activities or in a vehicle, result in errors, caused primarily by contact chatter, corresponding to a setting difference of several seconds within the time span of one minute. It is for this reason that a low-frequency balance wheel of the frequency usual for wrist watches cannot be directly synchronized with the required reliability.

In other known systems, setting or arrest instrumentalities are used which require supplementary electro-mechanical transducers. These known systems sometimes have a relatively high energy requirement.

SUMMARY OF THE INVENTION

It is an object of the present invention to provide a time-keeping apparatus which does not require a high power input to achieve a high stepping reliability.

It is another object of the present invention to provide an accurate time-keeping apparatus which has a high sensitivity and a low input power requirement, and which is not undesirably responsive to disturbances, such as mechanical shocks.

It is a further object of the present invention to provide an accurate time-keeping apparatus which is free of auxiliary blocking devices and yet is non-responsive to disturbances, such as mechanical shocks and the like.

It is an additional object of the present invention to provide an accurate time-keeping apparatus which is free of supplemental electro-mechanical transducers and non-responsive to mechanical shocks and similar disturbances.

The foregoing objects, as well as others which are to become clear from the text below, are achieved in accordance with the present invention by providing a time-keeping apparatus which includes a crystal oscillator, electronic frequency dividers and an electronically regulated mechanical time-keeping system, which is part of an indicating system. The indicating system is driven at at least two rpm's. At least one of these rpm's can be controlled to be higher and at least one of these rpm's can be controlled to be lower than a nominal rpm corresponding to the crystal frequency. A storage circuit, such as a bistable multivibrator, has one of its inputs coupled to an output of a frequency divider which has its input supplied from the crystal oscillator. The second input of the multivibrator is operatively arranged to receive pulses derived from the indicating system which has very nearly the same frequency as the pulses derived from the frequency divider. The output from the storage circuit is coupled, via a switching circuit, to the indicating system for changing the rpm of the indicating system.

In a preferred embodiment, the output from the storage circuit is coupled, via the switching circuit, to an electronically regulated mechanical time-keeping system which is part of the indicating system.

The mechanical time-keeping system may be a conventional balance wheel movement of a wrist watch.

A time-keeping apparatus, especially a quartz wrist watch, according to the present invention, includes a crystal oscillator, such as a quartz oscillator, and electronic frequency dividers, as well as an electronically controlled mechanical time-keeping system which is part of an indicating system in which setting differences with respect to the controlling quartz system are permitted, but where these differences are reversed in a relatively short time by the rpm regulation of the indicating system. The setting differences can be kept very small in systems of this kind. The setting differences can reach a detectable magnitude because of large external mechanical disturbing influences, but they can be reversed in as short a time as is selected.

In the invention, the substantially disturbance-immune quartz system and the electronic regulation circuitry are installed in a mechanically unchanged electronically controlled indicating system, and preferably in an electronically controlled balance wheel type wrist watch, which may be manufactured in large quantities.

It is therefore an advantage of the invention that by the utilization of available simple time-keeping devices, coupled with a supplementary electronic quartz control system, a utility quartz watch of high accuracy can be provided.

A further advantage with respect to a known solution consists in that the setting of the watch can occur at any time in simple fashion in that the indication system (for example, a customary electronically regulated balance wheel wrist watch movement) is arrested mechanically and that, at the same time,, two electronic frequency dividers are reset to the condition 0 with the aid of a switch. When the quartz wrist watch is started at the chosen time, the indication mechanism is set in motion and at the same time the switch for resetting the frequency dividers is actuated.

In accordance with the invention, the indicating system is driven by at least two rpm's and where at least one rpm can be controlled to be higher and at least one rpm can be controlled to be lower than a nominal rpm corresponding to the quartz frequency. A storage circuit, whose one input is controlled by the pulses of the divided crystal frequency and whose other input is controlled by impulses derived from the indicating system, preferably from the electronically controlled mechanical time-keeping system, is provided. The frequency of the indicating system of the mechanical time-keeping system is nearly the same as the frequency of the impulses of the divided crystal frequency. The output or outputs from the storage circuit controls a switching circuit for switching the rpm of the indicating system.

In an advantageous embodiment of the invention, the indicating system is driven through gears by an electronically controlled mechanical oscillating system, especially a low frequency balance wheel system where the rpm change occurs through the frequency change in that oscillating system.

A further possibility is offered in that the indicating system is driven through gears by an electronically controlled motor whose rpm change occurs through changes in the supplied energy and/or energy losses.

A particularly advantageous embodiment is achieved in that pulses, for example control or drive pulses, are derived from the electronically controlled mechanical time-keeping system. These pulses are fed to an electronic frequency divider, which, in turn, feeds the storage circuit so that a pulse occurs at the output of the frequency divider whenever, for example, the second hand of the indicating system has passed a certain angle proportional to the number of steps in the binary frequency divider.

In a further embodiment, pulses are produced by the indicating system by an electro-mechanical transducer, for example, a contact, or are produced with electronic means and are conducted to the storage directly or through an electronic frequency divider.

A particularly advantageous embodiment of the invention for achieving an economical solution — on the basis of the utilization of constructional elements which have been in mass production for a long time — can be derived from the exemplary embodiment illustrated in the accompanying drawings.

DESCRIPTIONS OF THE PREFERRED EMBODIMENTS

Figure 1:
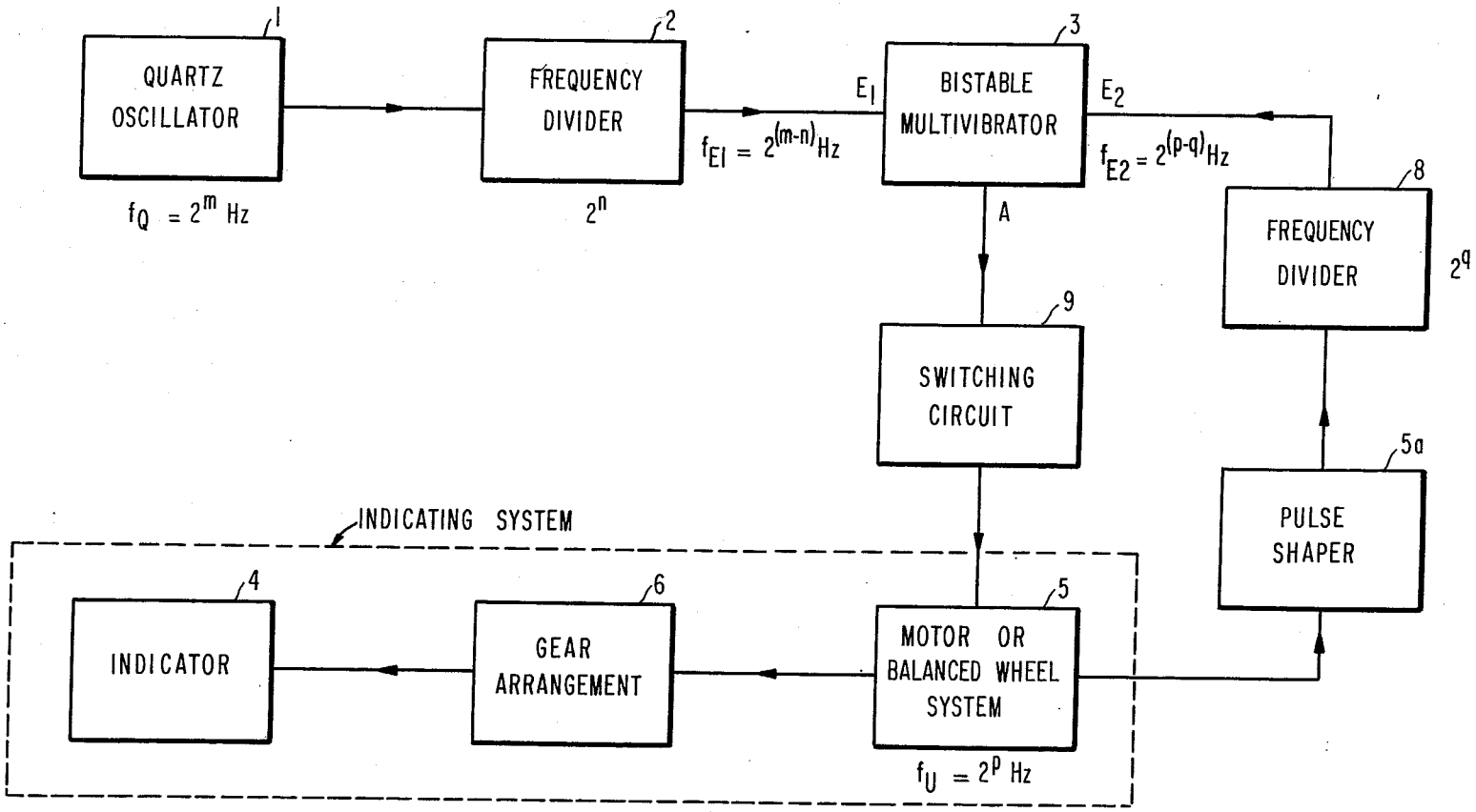
FIG. 1 is a block schematic diagram of a time-keeping apparatus having an electronically regulated indicating system according to the present invention, the illustrated apparatus being especially useful in a quartz wrist watch.

As illustrated in FIG. 1, a time-keeping apparatus, according to the present invention, includes a quartz oscillator 1 which controls a frequency divider 2. The output of the frequency divider 2 is fed to a first input E1 of a bistable multivibrator 3. An indicating system (for example, a conventional electronically controlled balance wheel movement of a wrist watch), shown within dashed lines, includes a motor or an electronically controlled balance wheel system 5 which drives an indicator 4 through gears 6, the indicator being, for example, the conventional hands of a wrist watch.

The electronically controlled balance wheel system 5 is coupled preferably, via a pulse shaper stage 5*a*, to a further electronic frequency divider 8, whose output is fed to a second input E2 of the bistable multivibrator 3.

An output A of bistable multivibrator 3 is fed to an electronic switching circuit 9. An output from the switching circuit 9 is coupled to and controls the balance wheel system 5.

A single battery cell (not shown) supplies power to all the elements shown in FIG. 1.

The operation of the exemplary embodiment of the time-keeping apparatus shown in FIG. 1 is explained below with the aid of FIG. 2.

The quartz oscillator 1 has the natural frequency $f_Q = 2^m$ Hz (for example, $m = 15$; $f_Q = 32.768$ kHz). The frequency divider 2 driven at this frequency has the dividing ration $2^n$:1 (for example $n = 21$). The output pulses from the frequency divider 2 are fed to the input El of the bistable multivibrator 3.

The electronically controlled balance wheel system 5, which, together with the gears 6 and the indicator 4, constitutes a conventional electronically controlled balance wheel movement of a wrist watch, has a mechanical frequency $f_{UM} = 4\text{ Hz} \pm \Delta f_{UM}$. Whenever the mechanical balance wheel movement, which preferably contains a dynamic transducer with a permanent magnet, passes through the zero position, a voltage pulse is produced. The electrical pulse sequence frequency is $f_U = 8\text{ Hz} \pm 2\,\Delta f_{UM}$.

Where:

$$2\,\Delta f_{UM} = f_{U1} - f_{U2}$$
$$f_{UM} = 4\text{ Hz} \pm (f_{U1} - f_{U2})/2$$

These pulses go to the pulse shaping stage 5*a* and hence to the second frequency divider 8, which has a dividing ratio of $2^q$:1. The output pulses of the frequency divider 8, which have the pulse frequency $f_U \cdot 2^{p-q}$, are fed to the second input E2 of the bistable multivibrator 3. The dividing ratios of the two frequency dividers 2 and 8 are chosen so that the frequencies $f_{E1}$ and $f_{E2}$ going to the inputs E1 and E2, respectively, of the bistable multivibrator 3, are equal, except for the chosen positive or negative frequency deviation.

The following relations hold:

$$f_{E1} = f_Q \cdot 2^{-n} = 2^{(m-n)}\text{Hz}$$
$$f_{E2} = f_U \cdot 2^{-q} = 2^{(p-q)}\text{Hz}$$
$$f_{U1} = f_Q \cdot 2^{(q-n)} + \Delta f_{U1};\ \Delta f_{U1} > 0$$

$$f_{U2} = f_Q \cdot 2^{(q-n)} + \Delta f_{U2};\ \Delta f_{U2} < 0$$
$$m - n = p = q$$

(example: $m = 15$; $n = 21$; $p = 3$; $q = 9$)

Figure 3A:
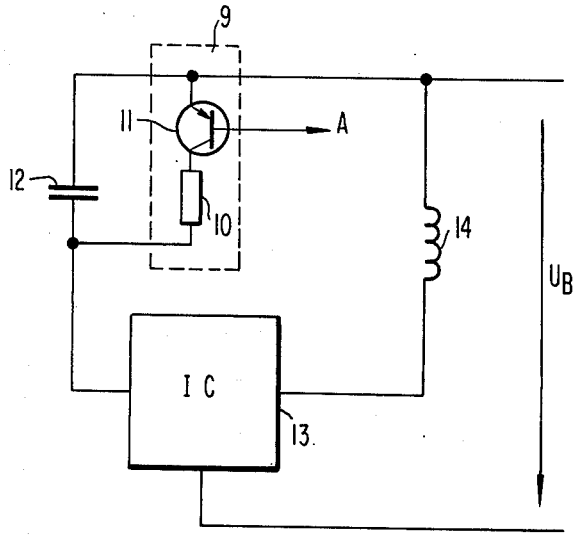
FIG. 3*a* is a schematic circuit diagram of a control and drive circuit of a balance wheel oscillating system associated with an electronic switching circuit for changing the balance wheel frequency, which are suitable for use in the circuit of FIG. 1.

The mechanical frequency of the electronically controlled balance wheel system 5 is switched by the output from the switching circuit 9, which is controlled by the output A of the bistable multivibrator 3. The elements 5 and 9 of FIG. 1 are shown in detail in FIG. 3*a*. The frequency change occurs because a resistor 10 (FIG. 3*a*) is switched into the circuit, parallel with a capacitor 12, with the aid of a transistor 11 acting as an electronic switch. When the transistor 11 is switched on, the effect is that in the triple magnetic system used, a shift of the negative voltage current characteristic occurs as seen at the ends of a coil 14, which causes a supplementary phase-shifted drive pulse at the coil 14. In the example, the supplementary drive pulse achieved a frequency increase (corresponding to a running change of approximately 2 minutes per day) of the electronically controlled balance wheel oscillatory system.

The balance wheel system is so regulated mechanically that when transistor 11 is switched on, there occurs at least an advance of the clock (i.e. a higher frequency) of approximately 1 minute per day; when transistor 11 is not turned on, a retardation (lower frequency) of approximately 1 minute per day occurs.

The drive pulses at the two different frequencies are produced by a known integrable circuit 13, e.g., similar to the circuit shown in FIG. 1 of Swiss Pat. No. 537,039.

Figure 3B:
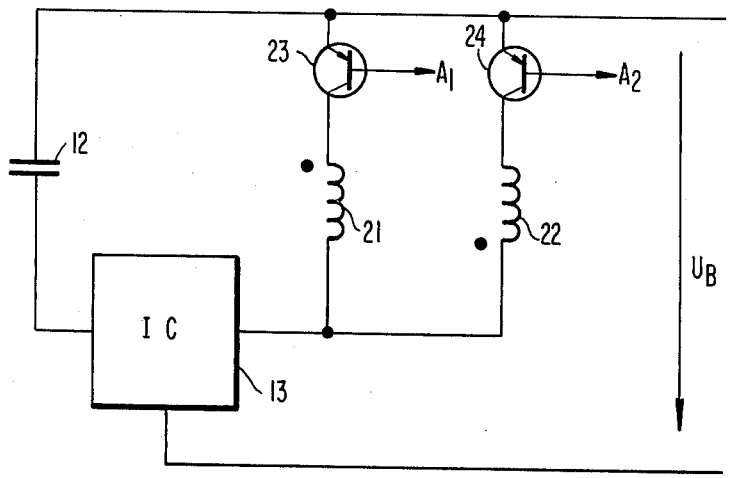
FIG. 3*b* is a schematic circuit diagram of a control and drive circuit similar to that of FIG. 3*a* which may be used in the circuit of FIG. 1.

In a further embodiment of elements 5 and 9, shown in FIG. 3*b*, two phase-reversed coils 21, 22 are energized alternately by transistors 23, 24, respectively, under the control of signals A1, A2, respectively, coming from two outputs of the storage circuit 3.

Hence the following relations are valid for the relative frequency changes of the balance wheel system:

$$\text{Advance:}\quad G_V = \frac{\Delta f_{U1}}{f_Q \cdot 2^{(q-n)}} = +1\ \text{min/d}$$

$$\text{Retardation:}\quad G_N = \frac{\Delta f_{U2}}{f_Q \cdot 2^{(q-n)}} = -1\ \text{min/d}$$

Figure 2:
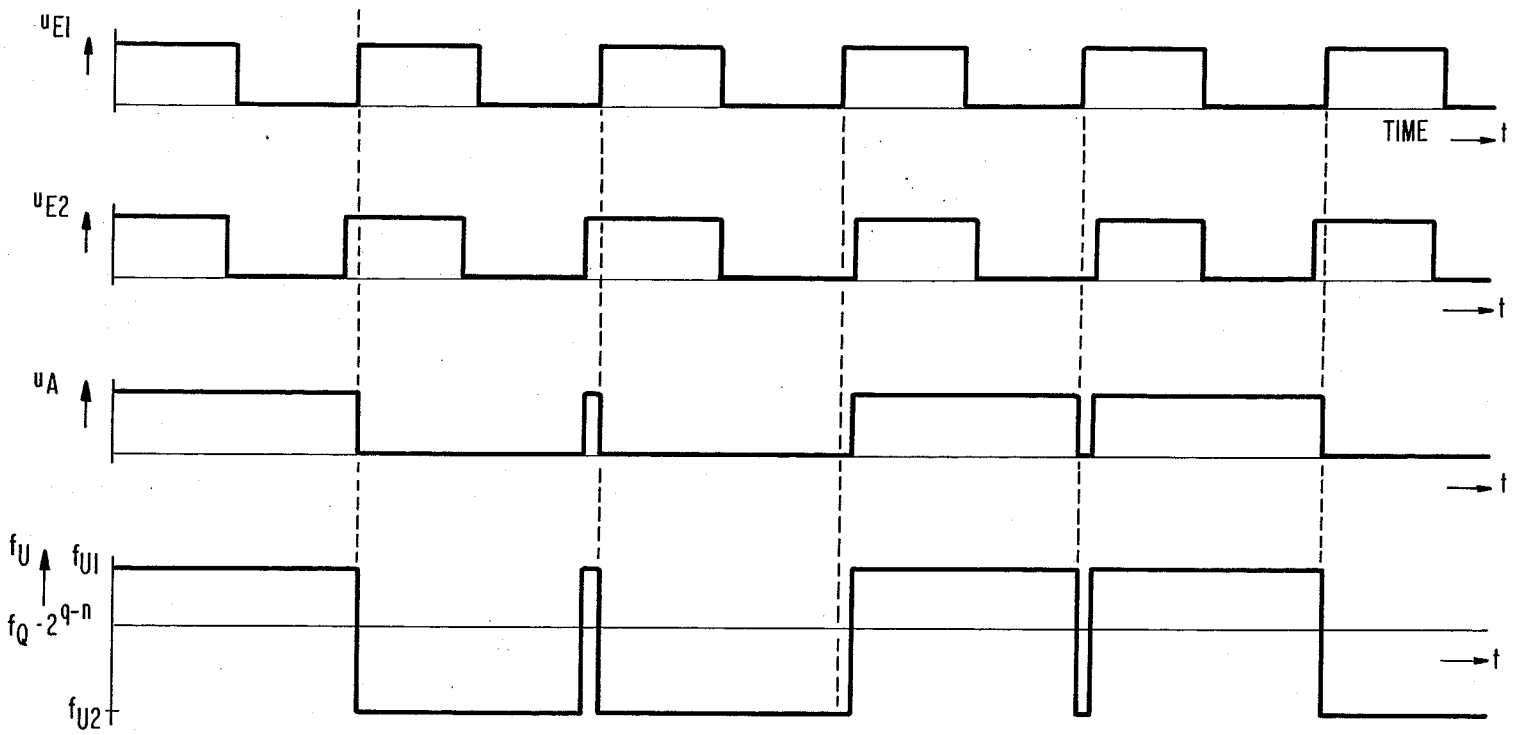
FIG. 2 is a timing diagram of voltages at the inputs and at the output of a bistable multivibrator, as well as of the balance wheel frequency $f_u$, the diagram being useful in understanding the apparatus of FIG. 1.

The input voltages $U_{E1}$ and $U_{E2}$, as well as the output voltage $U_A$, of the bistable multivibrator 3, are shown in a timing diagram of FIG. 2 as a function of time. The bistable multivibrator 3 is controlled by the positive edges of the pulses respectively arriving at its inputs E1 and E2.

When the quartz watch is operated, the following switching conditions or states can occur at the bistable multivibrator 3:

a. Let the output A be switched so that the balance wheel system has the frequency $f_{U1}$ (higher frequency). The pulse derived from the balance wheel system 5 arrives at the input E1 sooner. Hence this means that the balance wheel system 5 is faster than the quartz system and is switched to the frequency $f_{U2}$ by the positive edge of the pulse arriving at the input E1 last. This balance wheel frequency is maintained until the arrival of the following positive edge of the pulse at the inputs. In each case, the switching state of the bistable multivibrator 3 determines the balance wheel frequency.

b. If the pulse derived from the quartz oscillator 1 arrives at the input E1 prior to the arrival at the input E2 of the pulse derived from the balance wheel system 5, i.e. in case the balance wheel system 5 is slow, then the balance wheel frequency $f_{U1}$ is switched on by the positive edge of the pulse derived from the balance wheel system 5.

c. If, for example, because of external disturbances, the retardation or advance is not corrected within one period of the pulses arriving at the bistable multivibrator 3, then for a short time a frequency is switched on which does not correspond to the desired balance wheel frequency for regulating the system, but the time average of the balance wheel frequency until the next switching corresponds approximately to the required balance wheel frequency. Indication errors because of mechanical disturbing influences can temporarily amount to up to one-half of the period of the pulses arriving at the input E1; they are then corrected in a time period which is inversely proportional to the frequency changes $\Delta f_{U1}$ or $\Delta f_{U2}$.

Because of the fact that a balance wheel watch has very good long term running behavior due to the statistically distributed disturbances, the frequency changes $\Delta f_{U1}$ and $\Delta f_{U2}$ are chosen to be so small that no readable error occurs in the indication. Only if the mechanical external disturbances are extremely large, do visible deviations occur temporarily, but they are soon removed again by the regulation.

A remaining advance or retardation because of the frequency changes $\Delta f_{U1}$ or $\Delta f_{U2}$ of approximately 1 minute per day, results in a setting difference after 64 seconds of approximately 44 milliseconds which cannot be determined by the eye anyway.

It is to be appreciated that the foregoing description and accompanying illustrations relate principally to an illustrative embodiment. The text and drawings are not provided by way of limitation. Numerous variants and other embodiments are possible without departing from the spirit and scope of the present invention, the scope being defined in the appended claims.

What is claimed is:

1. A time-keeping apparatus comprising, in combination:

a. a time-indicating system, including electromechanical means, capable of periodic motion selectively at one of at least two non-zero operating frequencies, one of said operating frequencies being lower than said nominal frequency and another of said operating frequencies being higher than said nominal frequency;

b. pulse means, coupled to said time-indicating system for generating monitor pulses proportional in frequency to said operating frequencies of said indicating system;

c. quartz oscillator means for generating electrical pulses of a given frequency;

d. frequency divider means connected to said quartz oscillator means for generating a pulse train of nominal frequency;

e. logical control means having at least two inputs, one of said inputs being connected to receive said pulse train of nominal frequency and the other of said inputs being connected to receive said monitor pulses, and having an output the state of which depends on the states of said at least two inputs;

f. switching means, controlled by said output from said logical control means and connected to said time-indicating system, for selective electrical connection of portions of said electromechanical means to thereby cause a switch-over of the operating frequency of said electromechanical means from said one non-zero frequency to said another non-zero frequency;

whereby the relative phase difference between said pulse train at nominal frequency and said monitor pulses is compensated for.

2. A time-keeping apparatus according to claim 1, wherein said crystal oscillator means comprises a quartz crystal.

3. A time-keeping apparatus according to claim 1, wherein said electro-mechanical means comprises a balance wheel.

4. A time-keeping apparatus according to claim 3, wherein said balance wheel is the balance wheel of a wrist watch.

5. A time-keeping apparatus according to claim 1, wherein said storage means is a bistable multivibrator having two possible output states.

6. A time-keeping apparatus according to claim 1, wherein said electro-mechanical means comprises a low frequency balance wheel, time indicator means and gear means, said gear means being coupled between said balance wheel means and said time indicator means.

7. A time-keeping apparatus according to claim 1, wherein said indicating system comprises an electronically controlled motor, whose speed changes occur as a result of changes in supplied energy and/or energy losses.

8. A time-keeping apparatus according to claim 1, wherein said pulse deriving means includes an electromechanical transducer for producing pulses corresponding to the actual operating frequency of said indicating system.

9. A time-keeping apparatus according to claim 1, said time-indicating system including a drive circuit having at least one coil, a capacitor and an ohmic resistance, and wherein said switching means comprises a transistor arranged in a common emitter configuration and said transistor switches said ohmic resistance into and out of parallel connection with said capacitor for effecting a change in the operating frequency of said time indicating system.

10. A time-keeping apparatus according to claim 1, including a pair of spatially separate driving coils, and wherein said time indicating system includes an electronically controlled oscillatory system in which a change in natural frequency is achieved by selective energization of said spatially separate driving coils.

11. A time-keeping apparatus according to claim 1, wherein the operating frequency of said electromechanical means may be changed by changing the amplitude of its drive, for example, by changing supplied energy or by damping.

* * * * *